US005499879A

United States Patent [19]

Meetze

[11] Patent Number: 5,499,879

[45] Date of Patent: Mar. 19, 1996

[54] RIBBON CASSETTE DRIVE SYSTEM METHOD AND APPARATUS FOR PORTABLE COPIERS AND PRINTERS

[75] Inventor: Murray O. Meetze, Rochester, N.Y.

[73] Assignee: Xerox Corporation, Stamford, Conn.

[21] Appl. No.: 234,804

[22] Filed: Apr. 28, 1994

[51] Int. Cl.[6] ..... B41J 33/52

[52] U.S. Cl. ..... 400/234; 400/208; 400/120.01; 400/231

[58] Field of Search ..... 400/208, 234, 400/120.01, 120.02, 120.03, 120 MC, 231, 232, 233; 358/293, 294, 296

[56] References Cited

U.S. PATENT DOCUMENTS

| | | | |
|---|---|---|---|
| 3,939,957 | 2/1976 | Bittner | 400/231 |
| 4,299,504 | 11/1981 | Benze et al. | 400/208 |
| 4,414,555 | 11/1983 | Becker | 346/76 PH |
| 4,424,524 | 1/1984 | Daniele | 346/160 |
| 4,496,984 | 1/1985 | Stoffel | 358/293 |
| 4,507,667 | 3/1985 | Tsuboi | 400/234 X |
| 4,583,126 | 4/1986 | Stoffel | 358/294 |
| 4,621,270 | 11/1986 | Mizutani et al. | 400/233 X |
| 4,636,871 | 1/1987 | Oi | 358/296 |
| 4,688,050 | 8/1987 | Tsao | 346/76 PH |
| 4,812,063 | 3/1989 | Kunimitsu et al. | 400/234 |
| 4,920,421 | 4/1990 | Stemmle | 358/296 |
| 5,032,922 | 7/1991 | Stemmle | 358/296 |
| 5,040,074 | 8/1991 | Stemmle | 358/296 |
| 5,045,865 | 9/1991 | Crystal et al. | 346/1.1 |
| 5,144,331 | 9/1992 | Amano | 400/120.01 |
| 5,153,736 | 10/1992 | Stemmle | 358/296 |
| 5,153,738 | 10/1992 | Stemmle | 358/296 |
| 5,161,038 | 11/1992 | Hakkaku et al. | 358/496 |
| 5,162,916 | 11/1992 | Stemmle et al. | 358/296 |
| 5,187,588 | 2/1993 | Stemmle | 358/296 |
| 5,233,443 | 8/1993 | Sugiyama | 358/497 |
| 5,267,056 | 11/1993 | Stemmle | 358/472 |
| 5,342,131 | 8/1994 | Nakajima et al. | 400/234 X |

FOREIGN PATENT DOCUMENTS

| | | | |
|---|---|---|---|
| 0076289 | 5/1984 | Japan | 400/120 |
| 0074380 | 3/1990 | Japan | 400/120 |

*Primary Examiner*—Chris A. Bennett

*Attorney, Agent, or Firm*—Fay, Sharpe, Beall, Fagan, Minnich & McKee

[57] ABSTRACT

A ribbon cartridge and drive system for use in printers, typewriters, copiers or the like in which a supply spool and a take-up spool are enclosed in a housing with each spool extending from the housing for selective alternate engagement with a drive member connected to a brake member, both being coordinated with the movement of a printing head. A stripper bar peels the ribbon from a copy sheet downstream of printing head movement. The drive system cooperates with the printing head whereby a method of ribbon conservation is realized.

35 Claims, 13 Drawing Sheets

RIBBON CASSETTE DRIVE SYSTEM METHOD AND APPARATUS FOR PORTABLE COPIERS AND PRINTERS

BACKGROUND OF THE INVENTION

The present invention relates to very low cost portable compact scanners and printers. More particularly it is directed to a removable ribbon cassette and drive system accessary and method for use with a portable compact scanner copier/printer which facilitates simple ribbon replacement by consumers. In addition, the present invention relates to an improved thermal transfer printing process wherein the separating of the spent thermal transfer ribbon from the receiver sheet is enhanced by an "L" shaped mechanical member pivotally connected to a translatable thermal print head. Yet still, the present invention relates to methods of ribbon conservation.

Historically, copies of original documents have been produced by a xerographic process wherein the original document to be copied is placed on a transparent platen, either by hand or automatically through the use of a document handler, and the original document illuminated by a relatively high intensity light. Image rays reflected from the illuminated document are focused by a suitable optical system onto a previously charged photoconductor, the image light rays functioning to discharge the photoconductor in accordance with the image content of the original to produce an electrostatic latent image of the original on the photoconductor. The electrostatic latent image so produced is thereafter developed by a suitable developer material commonly referred to as toner, and the developed image transferred to a sheet of copy paper brought forward by a suitable feeder. The transferred image is thereafter fixed to the copy paper by fusing to provide a permanent copy while the photoconductor is cleaned of residual developer preparatory to recharging.

More recently, interest has arisen in electronic imaging where, in contrast to the aforedescribed xerographic system, the image of the document original is converted to electrical signals which may be processed, transmitted over long distances, and/or stored, are used to produce one or more copies. In such an electronic imaging system, rather than focusing the light image onto a photoreceptor for purposes of discharging a charged surface prior to xerographic development, the optical system focuses the image rays reflected from the document original onto an image reading array which serves to convert the image rays reflected to electrical signals. These signals are used to create an image by some means such as operating a laser beam to discharge a xerographic photoreceptor, or by operating some direct marking system such as an ink jet or thermal transfer printing system.

It is generally advantageous if the normally separate document reading and copy printing operations could be combined. If some of these reading/writing functions could be combined, system operation and synchronization could be simplified and system cost reduced through the use of fewer parts.

There are systems in the prior art that address the above identified concerns. For example, U.S. Pat. Nos. 4,496,984 and 4,583,126 to Stoffel, disclose an input/output scanner for simultaneously reading a document and writing a copy thereof. The document and copy sheet are fed in back to back relation with respect to a read/write station. A monolithic full width reading array scans each line in two steps, to improve resolution. The writing array of the read/write station consists of rows of ink jet nozzles, of which the number and disposition is in direct correspondence to the sensors of the read bar/array.

U.S. Pat. No. 4,424,524 to Danisle discloses a full width read/write LED array for scanning a document in the read mode or exposing the photoreceptor in the write mode. A Selfoc optical fiber lens array is used for focusing the full width LED array on the document or photoreceptor.

U.S. Pat. No. 4,724,490 to Tanioka teaches an image input device having an original exposing portion, an image sensor portion, and a thermal print head portion formed by heat generating members. The heat generating members are driven by a signal originating in the image sensor portion and are used to effect printing using a thermosensitive copy medium.

A difficulty with these prior art systems combining imaging and printing is the complexity and cost of separate components such as the complex optics, photoreceptor and developer such as in the Daniele system. In others such as the Stoffel system, it is necessary for an operator to manually combine a document and copy sheet into a single unit for manual insertion to machine feed rolls. Such a system also has a significant cost penalty associated with components such as the monolithic full width reading array.

Several patents assigned to the assignee of the instant application suggest a unique compact alternative to the above-described systems. These include U.S. Pat. Nos. 4,920,421, 5,040,074, 5,032,922, 5,153,736, 5,153,738, 5,162,918 and 5,187,588, all of which teachings are incorporated herein by reference.

The copier concepts described immediately above are attempts to reduce cost and complexity of such a copier while at the same time maximizing compactness and portability. Accordingly, all of the systems described therein rely on ink jet or thermal transfer print technology rather than the more bulky impact type printing apparatus.

Printing with ink jets requires specialized nozzles no which ink is supplied under pressure by a pump from a suitable manifold or other type of reservoir. Generally, the print heads of these systems are connected to a flexible umbilical ink supply tube. Of course, this extra hardware adds to the overall cost of the copier and unnecessarily complicates the print mechanism.

Thermal printing, on the other hand, is a non-impact printing process that enables formation of high resolution images. These printing processes are simple, offer low noise levels, and are very reliable over extended usages. Thermal printing processes may be classified into three categories. Direct thermal printing entails the imagewise heating of special papers coated with heat sensitive dyes, such that an image forms in the heated areas. Another method of thermal printing is known as the dye transfer or dye sublimation technique, and operates by heating a transfer element coated with a sublimable dye, which transfer element is not in contact with the receiving sheet. When the transfer element is imagewise heated, the dye sublimates and migrates to the receiver sheet, which possesses a polymeric coating into which the dye diffuses, forming the image. A third method of thermal printing is known as thermal transfer printing. The thermal transfer printing process entails imagewise heating of a transfer element containing ink. The transfer element is in intimate contact with a heater or heating element on one surface and a blank receiving sheen on the other surface. Imagewise heating of the transfer element affects the ink in such a way as to cause it to transfer from the transfer element to the receiving sheet, thereby resulting in image formation. Thermal transfer printing methods generally employ uncoated plain papers, which enables prints with acceptable appearance and excellent archival properties. In addition, the thermal transfer printing method can be employed for color printing applications by using transfer elements of the desired color or color combinations.

Thermal transfer printing processes generally employ a thermal printhead, a transfer element, and a receiver sheet. The side of the transfer element containing the ink is placed in contact with the receiver sheet, and heat originating from the printhead is then applied to the transfer element. Heat conducted through the element increases the temperature of the ink, which can cause it to melt, soften, decrease in viscosity, or otherwise undergo a transition that enables the ink to transfer to the receiver sheet. After the receiver sheet and transfer element are separated, an image remains on the receiver sheet. The operation of separating the transfer element from the receiver sheet, however, is critical in obtaining a crisp and smudge free copy product.

An alternative method of heating the transfer element, known as resistive heating, employs an array of electrodes instead of a thermal printhead to generate a current between the electrodes and a grounded conductive layer in the transfer element. This method is described in the IBM Journal of Research & Development, Vo. 29, No. 5, 1985, the disclosure of which is incorporated herein by reference. Additional information concerning thermal transfer printing processes is disclosed in Thermal Transfer Printing: Technology, Products, Prospects, published by Datek Information Services, P.O. Box 68, Newtonville, Mass., the disclosure of which is also incorporated herein by reference. Resistive heating methods also critically depends on a definite separating of the transfer element from the receiver sheet for obtaining a crisp final copy product.

As pointed out above, the process of stripping the transfer element from receiver sheet is an important consideration in portable thermal printers. However, perhaps equally significant is the tradeoff between i) the number of pages which can be printed before it becomes necessary to replace the thermal transfer element and ii) the bulk or overall physical size of the cassette structure carrying the transfer element on spools therein. This tradeoff is common to both portable thermal printers and copiers of the type described above.

One obvious method of increasing the number of successive documents created is to silly enlarge the thermal transfer element spool capacity within the cassette structure. However, generally, the length of the transfer element ribbon is proportional to the square of its spool diameter. For prior art systems using ribbon cassettes which move with the print head as illustrated in FIG. 1A to quadruple the ribbon capacity requires adding as much as one inch (1") to the ribbon cassette footprint height and one half inch (0.5") to the footprint width such as demonstrated in FIG. 1A. This results in an increase in volume of forty-two percent (42%) in the resultant size target copier/printer apparatus as best shown in FIG. 2B. The cassette according to the present invention allows for growth without impact on the overall size of the target printer/copier apparatus (FIG. 1C).

SUMMARY OF THE INVENTION

It is an object of the present invention to provide an improved compact copier or printer having thermal transfer printing capabilities with an easily replaceable ribbon supply cartridge.

It is another object of the present invention to provide a drive system adapted for use with the ribbon supply cartridge.

It is still another object of the present invention to provide a method of operating the drive system in conjunction with the replaceable ribbon supply cartridge for efficient use of the thermal ribbon.

Another object of the present invention is to enhance the thermal transfer printing process by providing a mechanical separating member downstream of a moving thermal printing head selectively engaging spent portions of the transfer element for separating the element from the receiver sheet.

Another object of the present invention is to separate the spent thermal transfer medium downstream of the moving thermal printing head on either the advance or return excursion of the head across the copy sheet to be coincident with the printing operation.

Yet another object of the present invention is to provide a combination brake element and drive element for control of dispensing new ribbon and making up of spent ribbon by appropriately applying a resistive force or a driving force to either the supply spool having a quantity of thermal ribbon thereon and a take-up spool connected to the other end of the ribbon.

These and other objects of the present invention are achieved in one embodiment by providing a pivotable stripper bar member on a thermal print head printing on an advance stroke in a portable copier or printer. The stripper bar selectively engages the spent thermal ribbon downstream of the print head for peeling the transfer element from the receiver sheet at a predetermined angle off-normal with respect to the receiver sheet plane at an appropriate time following the application of heat to the transfer element.

In another embodiment, a fixed stripper roller is provided on the thermal print head printing on the return stroke in a portable copier/printer.

The print head is connected to the drive system of the present invention for coordinating the supply of thermal ribbon to the print head with the position of the print head. The drive system also coordinates the supply of ribbon fed to the print head according to the extent of the printed matter on an original document in the portable copier.

The drive system includes a pivotable member for selectively applying an anti-rotational frictional force to a supply spool and a take-up spool in the replaceable ribbon supply cartridge. The pivotable member also selectively applies a spool driving force for taking up slack on either the supply or the take-up spool in the replacement ribbon supply cartridge.

BRIEF DESCRIPTION OF THE DRAWINGS

For a better understanding of the present invention, reference is made to the accompanying drawings wherein like reference numerals have been used for like or similar parts in several Figures and wherein.

DESCRIPTION OF THE PREFERRED EMBODIMENT

Figure 1A:
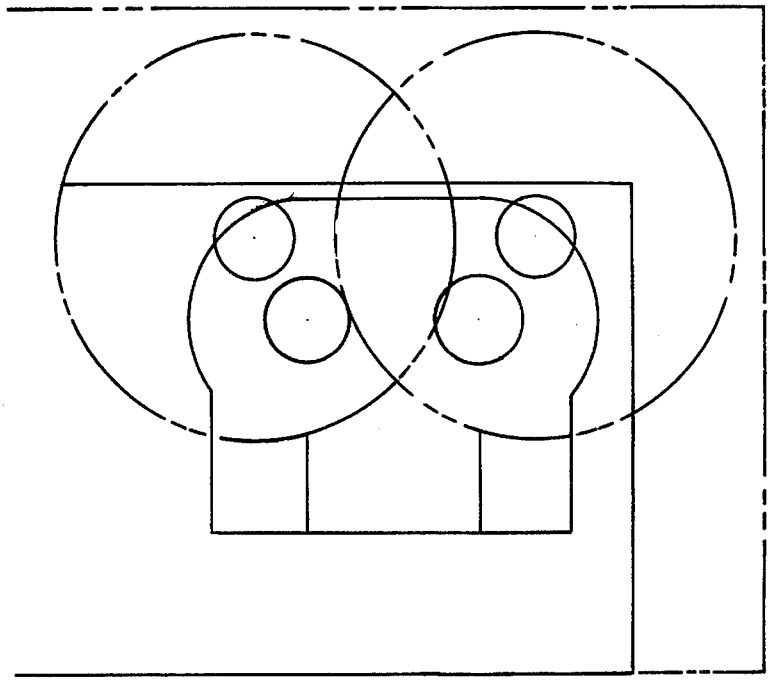
FIG.1A (PRIOR ART)
FIGS. 1A, 1B and 1C are illustrations of a prior art ribbon cassette, printer apparatus for use with the cassette of FIG. 1A and a cassette according to the teachings of the invention in a printer apparatus respectively.
Figure 1B:
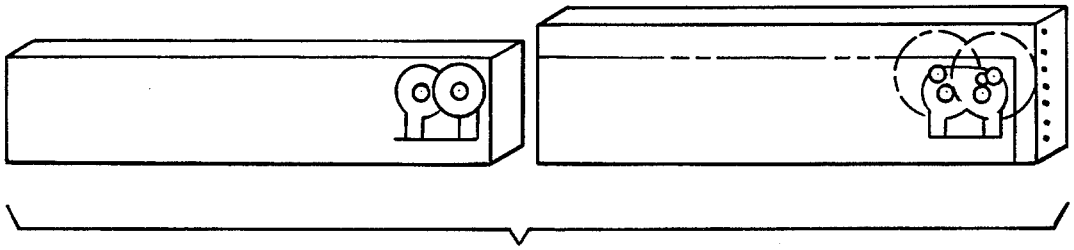
FIG.1B (PRIOR ART)
Figure 1C:
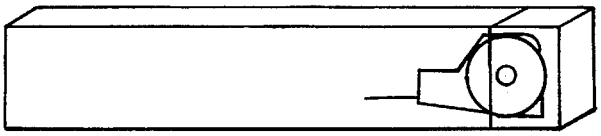
Figure 2A:
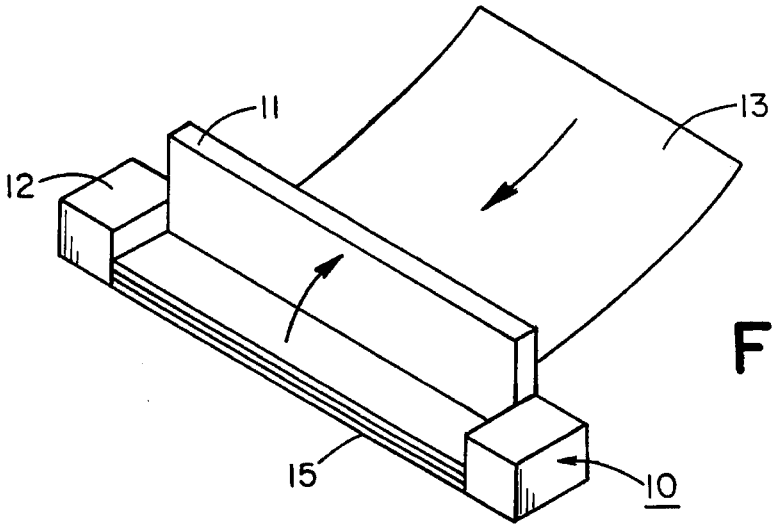
FIGS. 2A, 2B, and 2C are isometric views illustrating the general operation of a compact copier of the type the present invention is ideally applied.
Figure 2B:
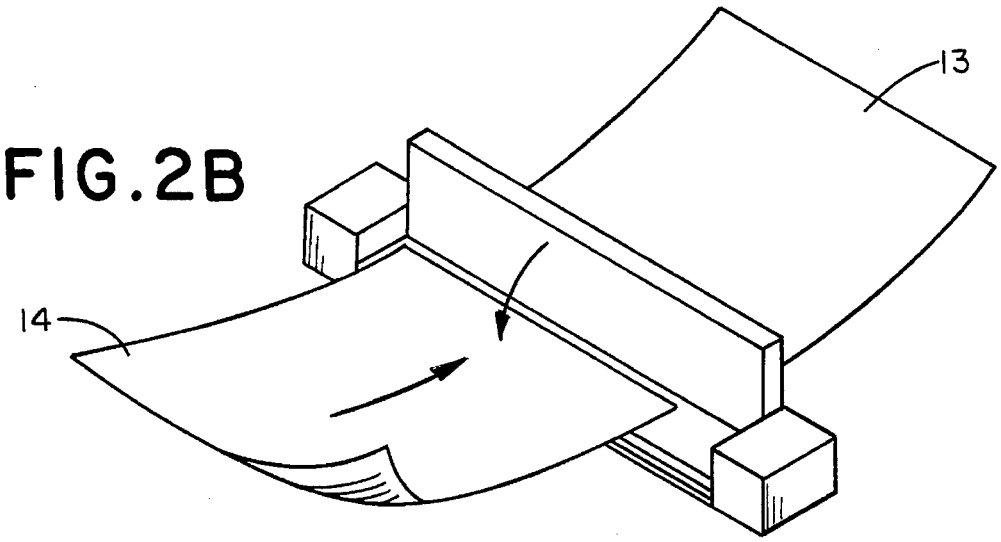
Figure 2C:
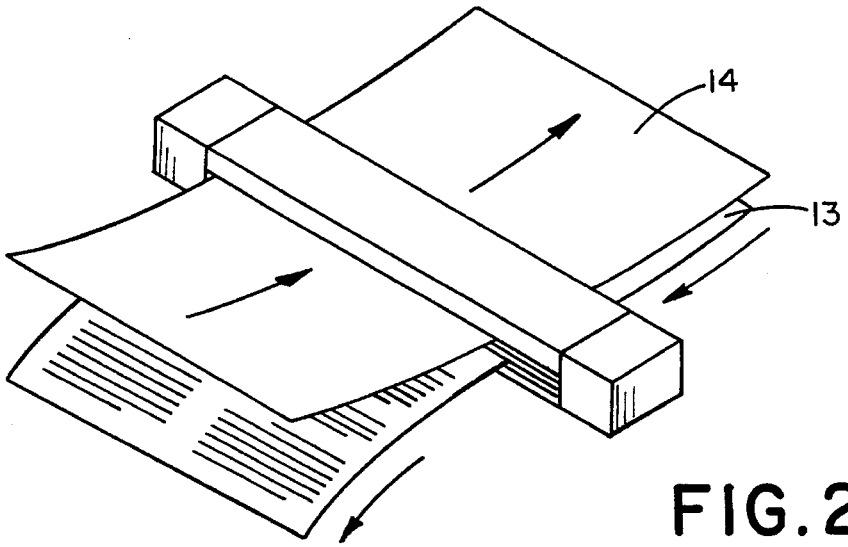

Referring now to FIGS. 2A, 2B, and 2C a general overview of the first preferred embodiment of the present invention used in a compact scanner is provided. The scanner is generally illustrated as comprising a frame assembly 15 which may have a maintenance station 12 at one end and a top cover 11 pivotally mounted to the frame assembly. To make a copy of document 14 the top cover is rotated to the open position as shown in FIG. 2A, a blank copy sheet 13 is inserted at the entrance of the copy sheet transport path and the document 14 is inserted against a registration stop member in the top cover after which the top cover is closed (FIG. 2B), The copying sequence begins by scanning carriage scanning a band of information across the document using a translatable. During the scanning operation, the document and copy paper are both held in a fixed position and the image on the document is digitized by an input digitizing system. In the preferred embodiment, a digital image is essentially simultaneously printed by a printing system on the copy sheet while the corresponding section of the original is being scanned. Subsequently, the document is indexed to the right and the copy sheet is indexed to the left (FIG. 2C) no enable the scanning carriage to scan a second band of information across the document. The distance of the longitudinal indexing of both the document and copy sheet is the width of the band of information across the document.

Figure 3:
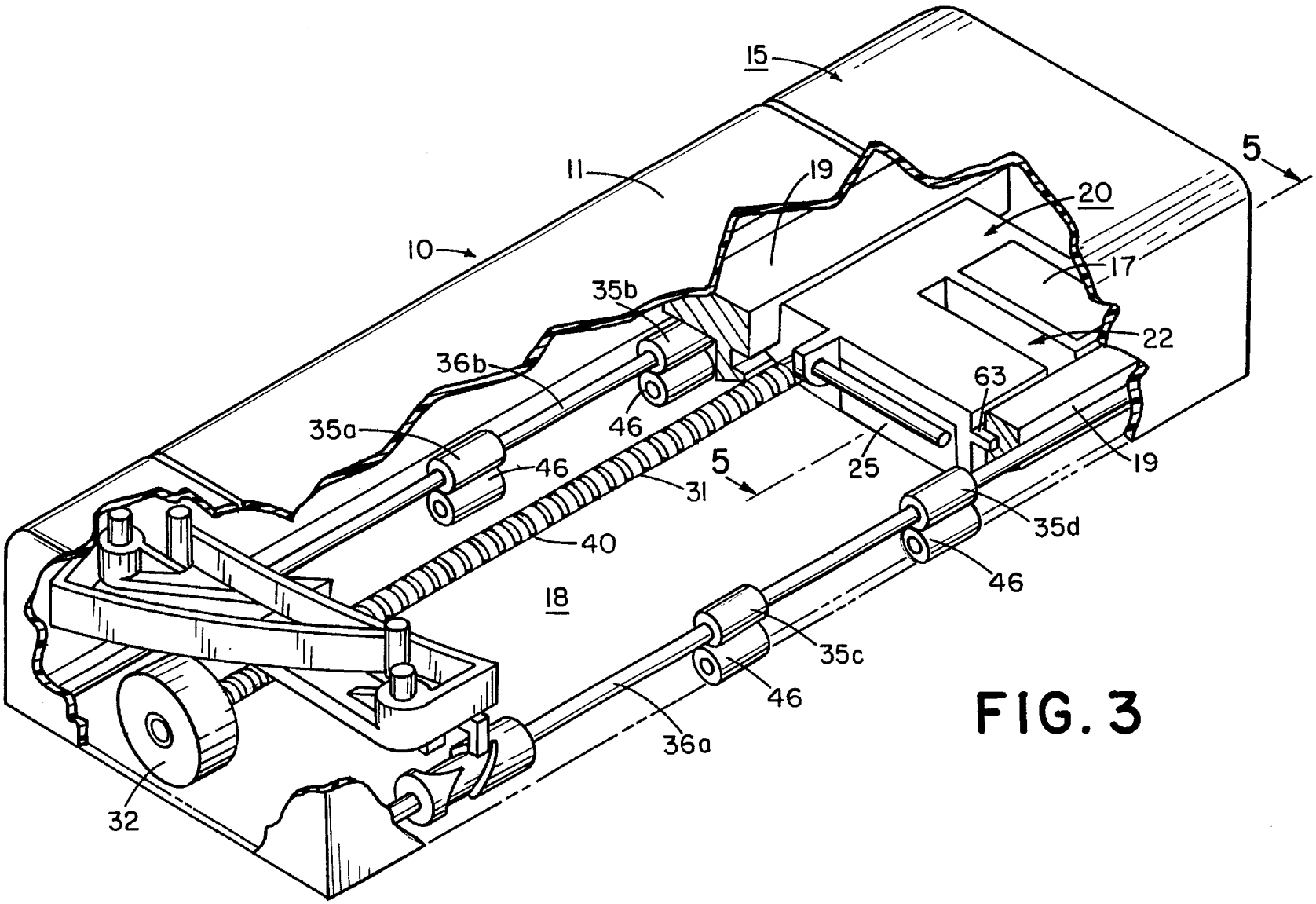
FIG. 3 is an isometric view of the compact scanner of FIGS. 2A–2C in partial cutaway with the top cover removed.
Figure 4:
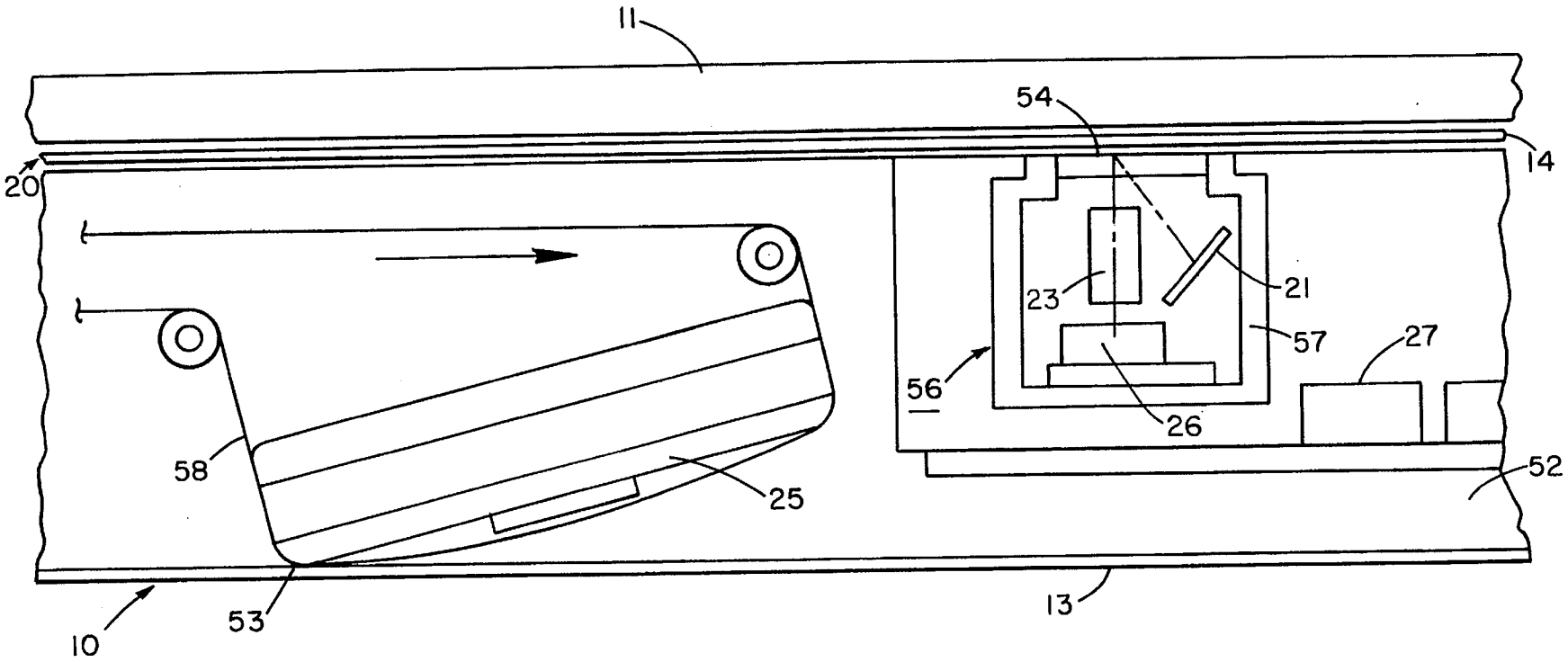
FIG. 4 is an enlarged sectional view illustrating the elements of a typical scanning and printing carriage of the type the present invention is ideally applied.

With additional reference to FIGS. 3 and 4 of the drawings there is shown a combined input scanner and output scanner designated generally by reference number 10. The scanner 10 includes a frame assembly 15 composed of a base unit 18, rails 19 within which a scanning carriage 20 is transported during its scanning path. When not in scanning operation the scanning carriage 20 is parked in the maintenance station 12 (FIG. 2A) to facilitate one or more of the following functions; clean the head, humidify the head; repair the head and change the ribbon cassette. This position will hereinafter be referred to as the home position.

The scanning carriage 20 includes a reading head 17 and a thermal printing head 25 mounted on a shared frame 52. The reading head comprises a contact image sensor, (CIS) 56, including an array of light emitting diodes 21 mounted to frame 57 for illuminating a document 14 adjacent a glass platen 54, an image of which is reflected through a lens 23 such as a Selfoc lens, to an input sensor chip 26 having an array of photosites for activation by the reflected radiation which is converted to electrical signals or pixels which are processed by an application specific integrated circuit (ASIC) 27 and subsequently transmitted to the printing head 25. The printing head is a thermal print head (TPH) 25 printing by heating ink impregnated in a ribbon 58 as described above and best illustrated in FIG. 4. Typically, the thermal print head comprises an array of heater elements or resistors 53, which when actuated, heat, to form pixels by melting a small portion of ink on ribbon 58 and pressing it into plain paper 13, essentially simultaneously in response to the image read by the reading head. During the operation the scanning carriage scans a document which is in an image plane and prints on the copy sheet which is in a parallel printing plane.

It will be understood that while reference has been made to reading heads and printing heads that the present invention encompasses in a generic sense solid state devices with input reading elements and solid state devices with output printing elements. It will also be understood that the number of scanning elements or sensors that comprise the image reading head 17 determine the initial scanning resolution while the number of heating elements 53 that comprise the printing head 25 determine the resolution of the image copy. Generally, However, the number of input scanning elements equals the number of output printing elements. Usually, the sensor chip has 384 photosites at 400 per inch or 16 per millimeter and the thermal print head also has 384 heater elements at 400 per inch or 16 per millimeter.

Both the reading head and the printing head are secured for movement on scanning carriage 20 which may be mounted for unidirectional scanning movement in a scanning path along the length of the frame assembly by means of scan stepper motor 32 through lead screw 31 to move the scanning carriage on the rails 19. The reading and printing heads are separated on the scanning carriage 20 by a gap 22 adapted to loosely receive the ribbon 58 therethrough.

As the motor rotates the lead screw, the grooves 40 in the lead screw engage threads (not shown) on the interior of the scan carriage to translate the read/write carriage along the lead screw. This motion pulls the ribbon 58 off a spool and through the gap 22. The pitch on the lead screw is selected, such that, each pulse or every second, third or fourth pulse, of the stepper motor corresponds to one pixel width or one 1/400th inch of carriage motion. This enables the same clock pulse generator used to drive the stepper motor to be used to trigger the read/write systems on the scanning carriage. Alternatively, a D.C. motor may be used to actuate the lead screw and together with an encoder wheel generate a signal which is used to trigger the read and/or write functions.

Following a scanning run in either direction across the length of the frame assembly (printing on advancing stroke or returning stroke), the document and the copy sheet are each indexed through the scanner in opposite directions a distance equal to the width of the band of information on the document scanned by the reading head which is the same width as the width of the band of information printed on the copy sheet by the thermal printing head. This width can be any width from a minimum of a single pixel line to a maximum of the width of the entire document in practical terms, however, in order to minimize the size and the cost of the read and write components, the width of the band is of the order of a fraction of an inch to several inches wide. The preferred method for achieving this alternating scanning/printing and sheet indexing is illustrated with further reference to FIG. 3 in conjunction with FIGS. 5–10 wherein an indexing means is provided comprising rotatable drive rolls 35*a, b, c* and *d* mounted on drive roll shafts 36*a* and 36*b* forming feeding nips for a document with document feed idler rolls contained within the top cover 11 of the scanner. The term "synchronously driven" is intended to define only that the shafts 36 are synchronized to each other. The drive rolls 35*a, b, c* and *d* also form feeding nips for a copy sheet with the copy sheet idler rolls 46 in the copy sheet transport path.

Figure 5:
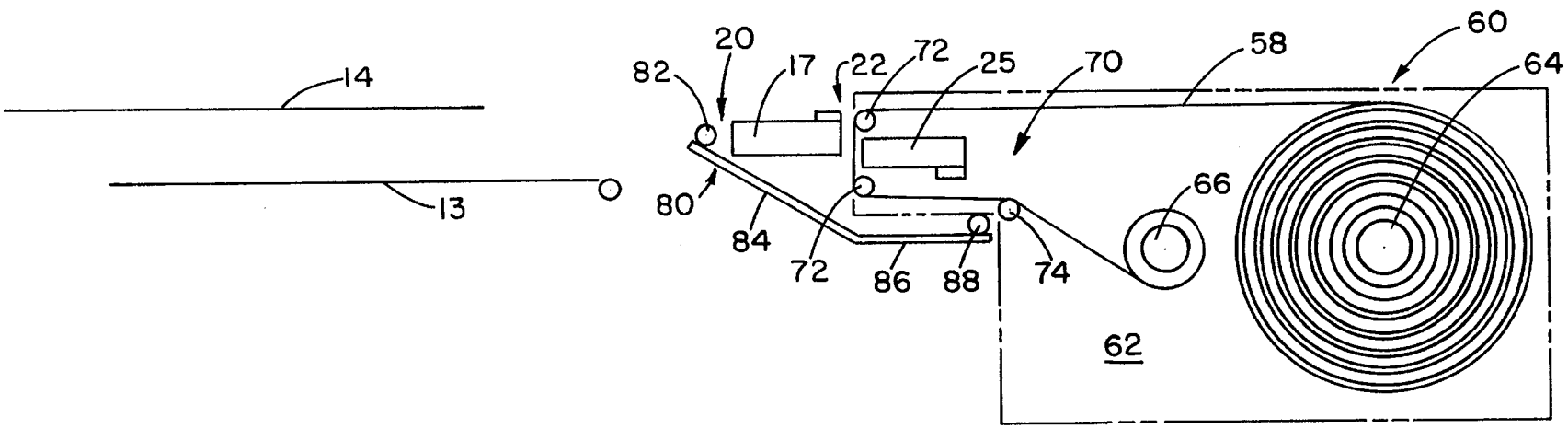
FIG. 5 is a partial cross sectional view of the compact scanner taken along line 5—5 of FIG. 3 with the scanning carriage at home position and with a replaceable ribbon cassette installed.

With the read/write carriage in the home position, the thermal printing head 25, as well as the reading head 17, is exposed for normal maintenance and repairs and also for convenient ribbon replacement. According to the preferred embodiment of the instant invention, the ribbon 58 is housed within a portable consumer replaceable ribbon cassette apparatus attachable to the copier 10 near the maintenance station 12 using any suitable clips, clamps, hooks or the like. As best shown in FIG. 5, the ribbon cassette 60 includes a housing 62 formed of a rigid lightweight, but durable material such as plastic. The housing 62 includes a generally planar surface adapted to receive a pair of ribbon spools thereon. A supply spool 64 is initially loaded with a quantity of ribbon 58 thereon. The take-up spool 66 is initially empty but connected to a first end of the ribbon 58. Each of the spools 64, 66 are freely rotatable within the housing 60 and adapted to engage a cassette drive system to be described in detail below. In the preferred embodiment, each of the spools 64 and 66 include axle portions extending through the housing 60 and connected to circular members outside of the housing.

With continued reference to FIG. 5, the ribbon cassette 60 includes a ribbon presentation element 70 for convenient threading of the ribbon 58 between the thermal printing head 25 and the reading head 17 through the gap This is especially useful during ribbon cassette replacement. The ribbon presentation element 70 includes a first pair of ribbon guides 72 positioned on the cassette housing and engageable with corresponding members (not shown) on the copier 10 to ensure that the ribbon 58 is properly registered in the gap 22 when the cassette 60 is installed with the scanning carriage at the home position. An auxiliary guide roller 74 is positioned on the housing to prevent the ribbon 58 from snagging on or otherwise contacting the interface between the ribbon presentation element and the housing walls.

With continued particular reference to FIG. 5, the scanning carriage 20 of the compact scanner includes a pivotable stripper bar 80 attached to the scanning carriage 20 at a first pivot point 82. The stripper bar 80 includes a first upper extension member 84 connected to a second lower extension member 86. The second lower extension member 86 is joined on its end by a stripper roller 88 which engages the ribbon 58 during the printing operation in a manner to be discussed below. In general, both the first extension member 84 and the second extension member 86 lie in a direction substantially corresponding to the direction of movement of the scanning carriage 20. On the other hand, the first pivot point 82 and the stripper roller 88 extend substantially perpendicular with the direction of movement of the scanning carriage 20 or into the page as viewed in the FIGURE. A general "L" shape is thereby formed. The stripper roller 88 is free to rotate so as not to score, tear or otherwise destroy the ribbon during the printing operation.

Figure 6A:
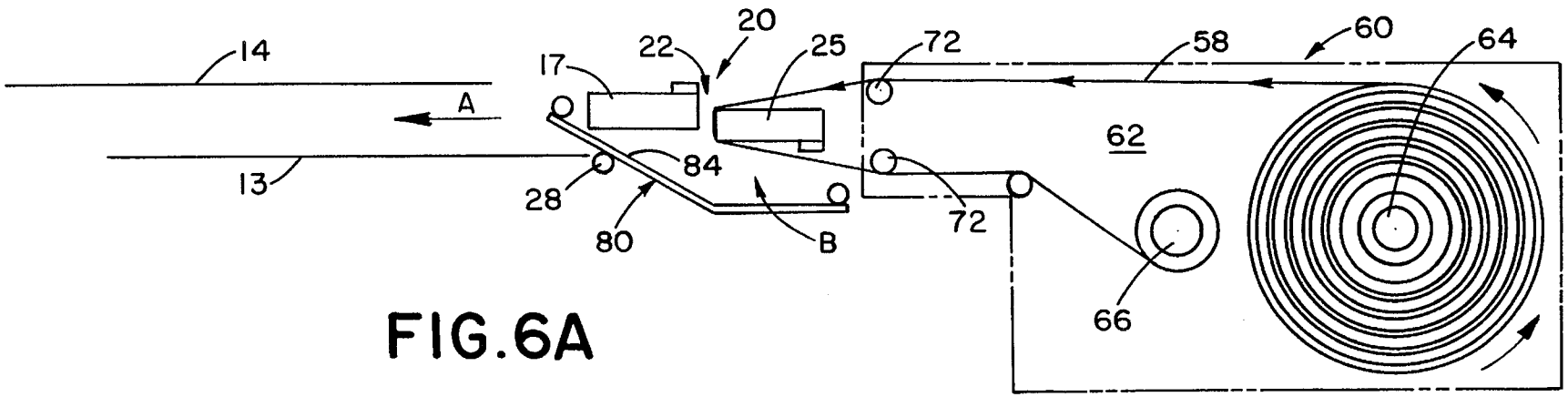
FIGS. 6A and 6B illustrate the operation of the ribbon cassette of FIG. 5 and a drive system, therefor, respectively as the scanning carriage advances in preparation of a copy operation.
Figure 6B:
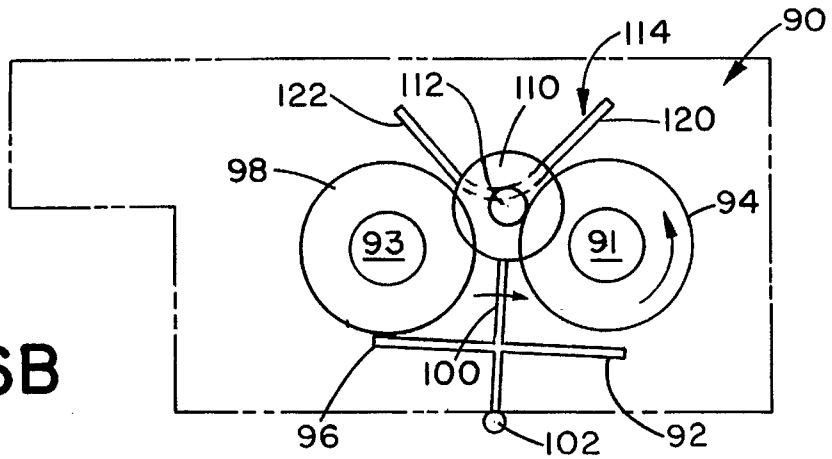
Figure 7A:
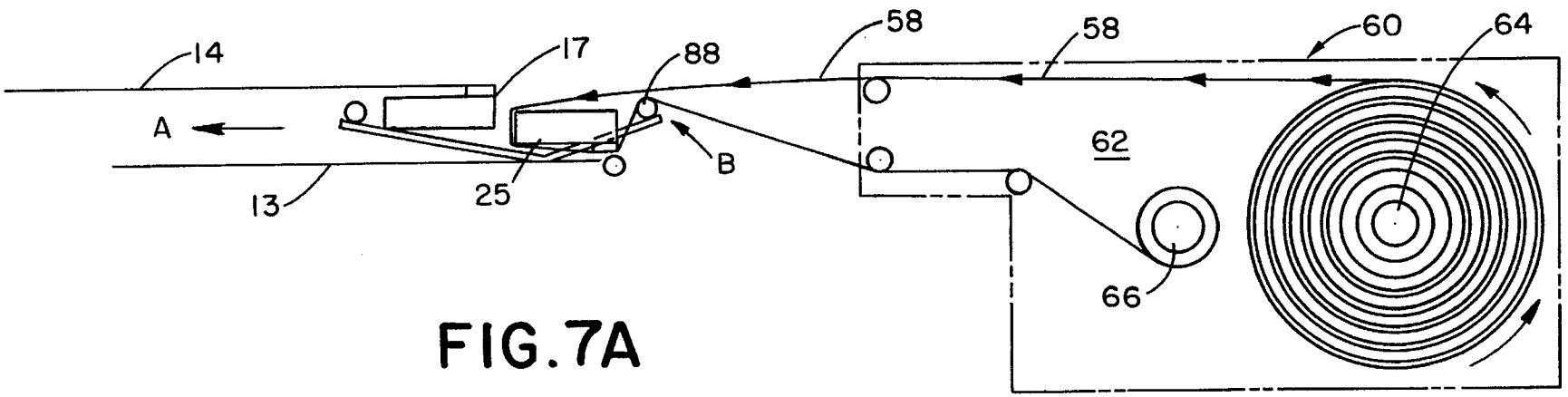
FIGS. 7A and 7B illustrate the operation of the ribbon cassette and drive system respectively as the scanning carriage advances and dispenses new ribbon while printing.

With the read/write carriage in the home position illustrated in FIG. 5, the stepper motor 32 rotates the lead screw 31, which translates the carriage 20 in an imaging sweep across the copier frame 15. FIGS. 6A and 6B illustrate the operation of the stripper bar 80 and the drive system 90 at the beginning of the aforementioned imaging sweep. More particularly, and with reference first to FIG. 6A, the scanning carriage 20 is illustrated in a position offset somewhat from the home position illustrated in FIG. 5. As illustrated in FIG. 6A, fresh ribbon 58 is unrolled from the supply spool 64 due to the movement of the scanning carriage. The ribbon 58 is effectively pulled through the gap 22 of the scanning carriage. At the position illustrated in FIG. 6A, the stripper bar 80 engages a boss 28 on the frame assembly of the copier apparatus. The boss 28 is aligned with at least one of the first pair of roller guides 72 of the ribbon cassette 60. As the scanning carriage 20 moves in the scanning direction A, the extension members 84 of the stripper bar 80 engage the boss 28 urging the stripper bar into pivotal motion generally in the direction B. FIG. 7A illustrates the scanning carriage 20 well into the imaging sweep wherein the stripper roller 88, held by the bail second extension member 86, effectively strips or peels the spent ribbon from the thermal printing head 25 during the imaging sweep.

With reference to FIG. 6B, the drive system 90 of the preferred embodiment is illustrated. The drive system includes a supply spool brake member 92 and a take-up spool brake member 96. The supply spool brake member 92 selectively engages a supply spool circular member 94 extending from the ribbon cassette and connected to the supply spool 64 through the housing 62 with a supply spool axle. Similarly, the take-up spool brake member 96 selectively engages a take-up spool circular member 94 which is connected to the take-up spool 66 through a take-up spool axle 93. The supply spool brake member 92 and the take-up spool brake member 96 are connected to a control member 100 which is pivotable about a pivot point 102. A small D.C. or stepper motor 110 is attached to the control member 100 and includes a first drive wheel 112 engaging a raceway 114. The raceway includes a first ramped surface 120 near the supply spool circular member 94 and a second ramped surface 122 adjacent the take-up spool circular member 98. In the preferred embodiment, the raceway 114 is only semi-rigid to permit some flexing thereof in order to accommodate pivotal motion of the control member 100 and drive wheel 112. Materials which exhibit the resilient characteristics similar to piano wire fixed to the housing on both ends work well for the raceway 114. This resilient raceway provides the force to urge the motor shaft in contact with the circular member 94 and also to urge the break member 96 into contact with the circular member 98.

In the position illustrated in FIG. 6B which corresponds to the position of the printing operation illustrated in FIG. 6A, the electric motor 110 is in an OFF or brake state. The shaft of the motor 110 serves as a small drive wheel 112, enlarged in the Figures for ease of reference and discussion, which engages both the first surface 120 and the supply spool circular member 94. In this position, the supply spool 64 is rotatable against the frictional force between the drive wheel 110 and the supply spool circular member 94. On the other hand, the take-up spool circular member 98 is engaged with the take-up spool brake member 96 due to the toggle position of the control member 100 and the urging force provided by the resilient raceway 120. Accordingly, as the scanning carriage 20 advances in the scanning direction A, the ribbon 58 is pulled from the supply spool 64 against the frictional force between the drive wheel 112 and the supply spool circular member 94. The take-up spool is effectively locked due to the engagement of the take-up spool brake member 96 with the take-up spool circular member 98.

Figure 7B:
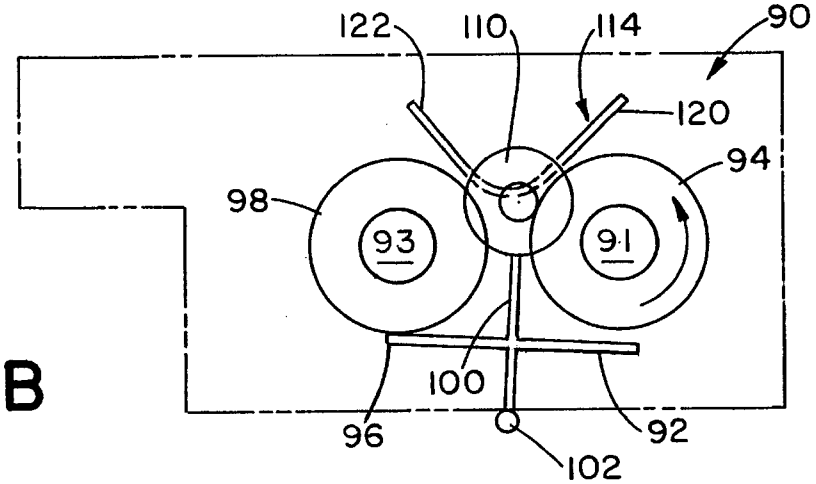
Figure 8A:
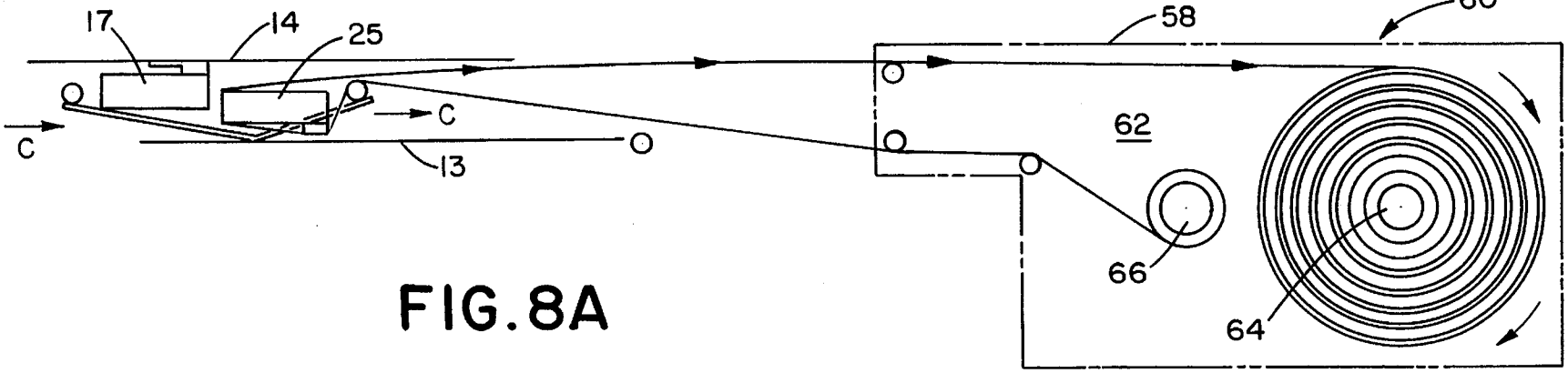
FIGS. 8A and 8B illustrate the operation of the ribbon cassette and drive systems respectively as the scanning carriage partially retracts back toward home position of FIG. 5.
Figure 8B:
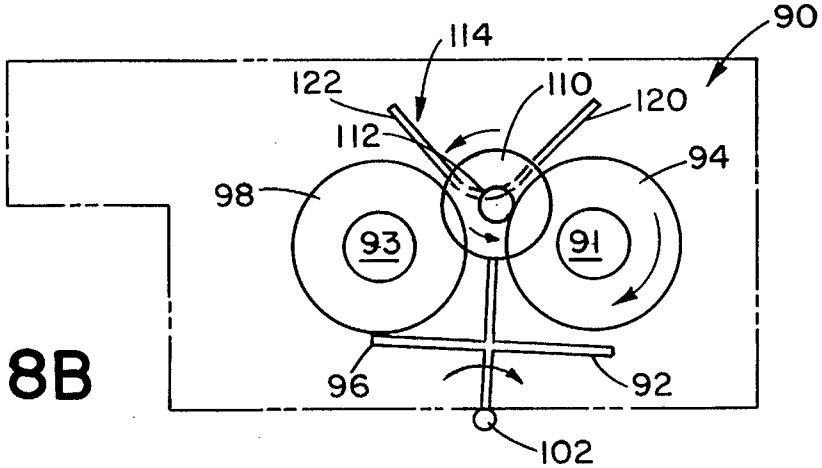

FIGS. 7A and 7B illustrate the operation and function of the ribbon cassette 60 and the drive system 90 during the scanning process, As illustrated, the reading head 17 reads information from the document 14 while the thermal printing head 25 simultaneously prints the same information onto the copy sheet 13 as the carriage moves in the scanning direction A in a manner described above. Further, as the scanning carriage progresses, the stripper roller 88 effectively peels away the unused portions of the thermal ribbon 58 downstream of the printing process. The angle between the first extension member 84 and the second extension member 86 as well as the length thereof determine the sheering angle between the thermal ribbon under the print head 25 and the spent ribbon between the print head and the stripper roller. This prevents the thermal ribbon from sticking or otherwise adhering to the copy sheet 13. As shown in the Figures, the supply spool 64 as well as the supply spool circular member 94 rotate while the take-up spool 66 and the take-up circular member 98 are held stationary.

Figure 9A:
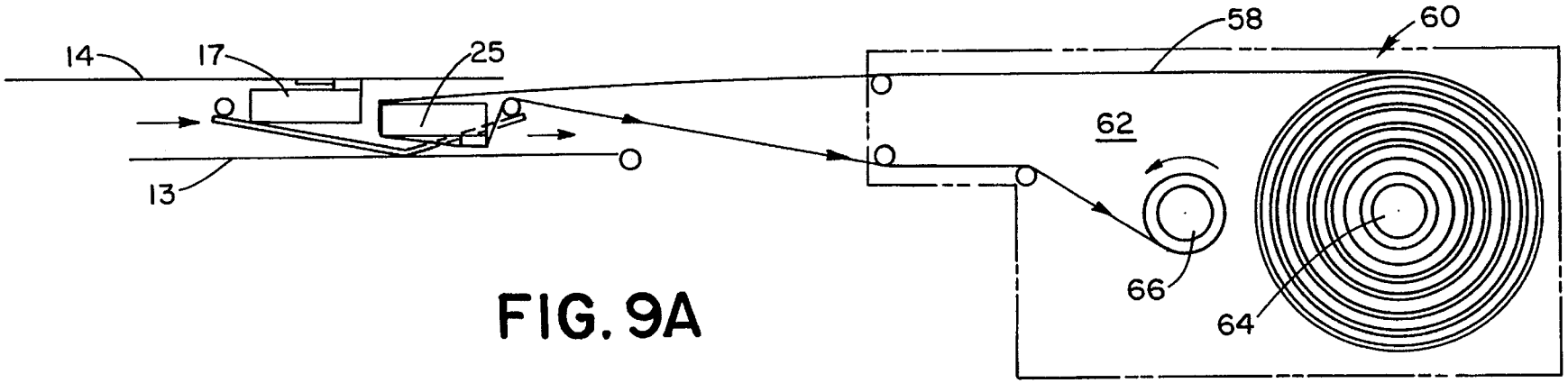
FIGS. 9A and 9B illustrate the operation of the ribbon cassette and drive system respectively as the scanning carriage completes its movement toward home position.
Figure 9B:
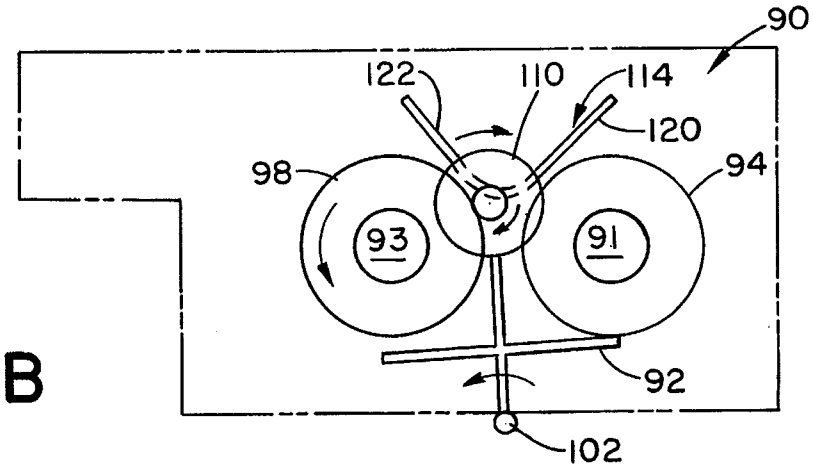

After The original document is scanned and the copy completed, the scanning carriage 20 reverses direction and moves toward either the home position (FIG. 5) or the ready position (FIG. 7A). Before the scanning carriage 20 commences movement in the returning direction C, the electric motor 110 is powered rotating the drive wheel lit in the counter clockwise direction marked in FIG. 8B. The relative coefficient of friction between the first surface 120, the drive wheel 112, and the supply spool circular member 94 are selected such that the supply spool is effectively driven in the rotational clockwise direction illustrated in FIG. 8A. In addition, the take-up spool brake member 96 is positively inserted into engagement with the take-up spool circular member 98 to effectively hold fixed the take-up spool 66. Accordingly, while the scanning head traverses in the reversing direction C, portions of the ribbon 58 extending from the cassette 60 are rewound onto the supply spool 64. However, at a predetermined position along the excursion of the scanning carriage 20, the electric motor 110 is energized in an opposite direction to rotate the drive wheel 112 clockwise as illustrated in FIG. 9B. The reversing rotation of the drive wheel 112 causes the control member 100 to toggle about the pivot 102 to the position illustrated in FIG. 9B. In this position, the supply spool brake member 92 engages the supply spool circular member 94 to effectively hold fixed the supply spool 64 preventing its rotation. Conversely, the take-up spool 66 is urged into counterclockwise rotation as illustrated in FIG. 9A through the interaction of the drive wheel 112 with the take-up spool circular member 98. As illustrated in FIGS. 9A and 9B, the spent ribbon extending from the cassette 60 is wound onto the take-up spool 66 for the remainder of the movement of the scanning carriage 20 and the reversing direction C.

With reference now to FIGS. 10A–F, a method for effective ribbon conservation and utilization according to the present invention will be described in detail using simplified representations of the scanner, ribbon cassette and brake members. Although the method described finds particular application in apparatus which print on the advancing stroke, only simple modification is required in the method steps for adaptation to apparatus which print on the print head return stroke.

Figure 10A:
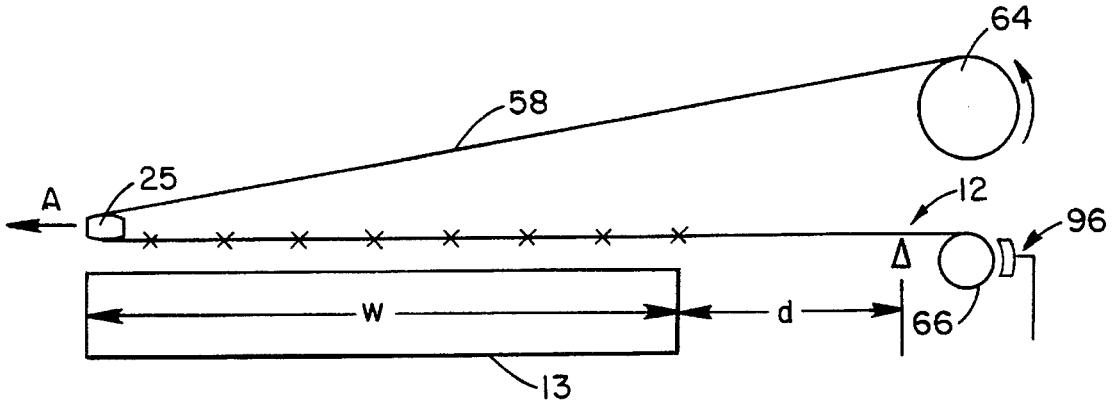
FIGS. 10A–10F schematically illustrate a method of printer ribbon dispensing control corresponding to the printing operation illustrated in FIGS. 6–9.

FIG. 10A illustrates the thermal printing head 25 at the extreme end of travel in the scanning direction A after completing a copy onto a copy sheet 13 according to the procedures described above. As illustrated in FIG. 10A, the copy sheet 13 has a width w. The length of ribbon 58 extending from the supply spool 64 to the thermal printing head 25 is unused. However, a portion of the ribbon 58 extending between the take-up spool 66 and a thermal printing head 25 is used. The used portion is hereinafter schematically illustrated using a series of "x" s. The distance between the leading edge (printing head at ready position, FIG. 7A) of the copy sheet 13 and the home position (printing head at the maintenance stations FIG. 5) is schematically represented as the distance d. As indicated above, during the scanning/printing operation, the supply spool 64 is permitted to rotate as illustrated in FIG. 10A while the take-up spool 66 is held fixed using the take-up spool brake member 96.

Figure 10B:
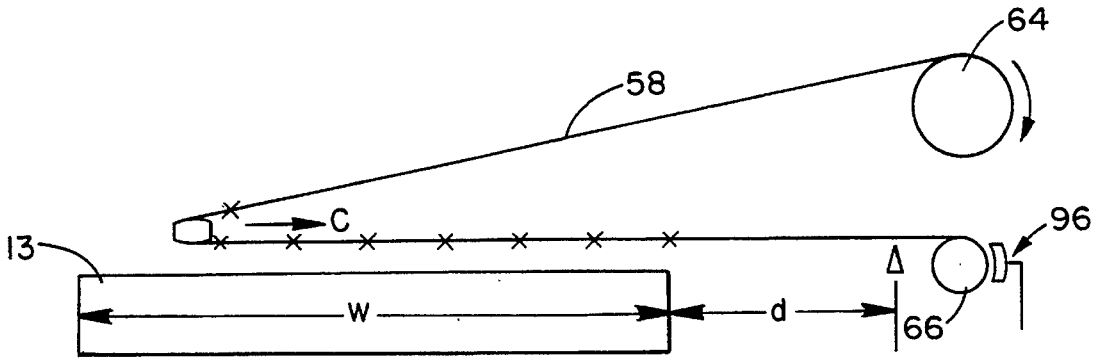

With reference now to FIG. 10B, the supply spool 64 is urged to rotational movement through the interaction of the motor 110 and the drive wheel 112 on the supply wheel circular member 94 such as described above in connection with FIGS. 8A and 8B. The take-up spool 66 is held fixed by the take-up spool brake member 96. During a first portion of the movement of the scanning carriage in the reversing direction C, a portion of the ribbon 58 is rewound onto the supply spool 64. Also, as schematically represented in FIG. 10B, a used portion of the ribbon 58 is rewound into the region between the thermal printing head 25 and the supply spool 64. Rewinding in this manner is continued until the thermal printing head 25 reaches a position illustrated in FIG. 10C.

Figure 10C:
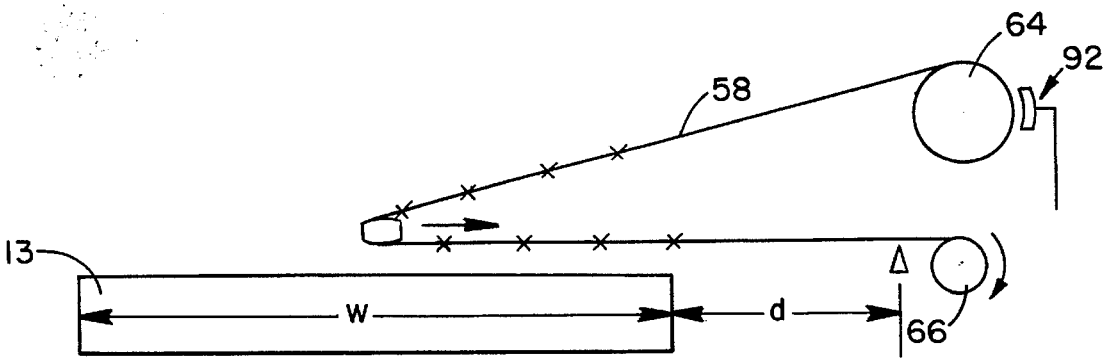

FIG. 10C illustrates the thermal printing head at a position midpoint between the extreme edges of the copy sheet 13. That is, the thermal printing head 25 translates in the reversing direction C, a distance w/2. At this position, the motor 112 is reversed in a manner described above FIG. 9B) This effectively clamps the supply spool 64 using the supply spool brake member 92 and engaging the supply spool circular member 94. The clockwise rotation of the drive wheel 112 urges the take-up spool into rotational movement to wind that portion of the ribbon 52 between the thermal printing head 25 and the take-up spool thereon. This operation continues until the thermal printing head reaches the ready position illustrated in FIG. 10D.

Figure 10D:
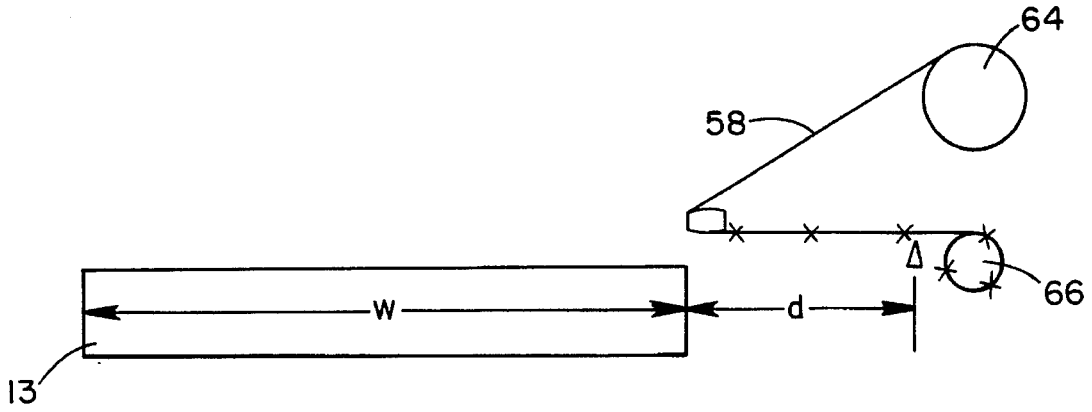

As indicated above, FIG. 10D schematically illustrates the thermal printing head 25 in the ready position wherein only new portions of ribbon 58 exist between the thermal printing head 2B and the supply spool 64. All of the spent ribbon is positioned between the thermal printing head 25 and the take-up spool 66. The ready position is also illustrated in FIG. 5. In this position, both the document 14 and the copy sheet 13 are advanced the width of the scanning band described above. There is no need for the thermal printing head to retract any further along the reversing direction C. On the contrary, once the copy sheet 13 and the document 14 are advanced, the predetermined scanned width amount, the thermal printing head moves once again in the scanning direction A illustrated in FIGS. 10A, 6A and 7A. Thus, the steps illustrated in the sequence from FIG. 10A through 10D are repeated until the entire document is scanned and the copy sheet is completed.

Figure 10E:
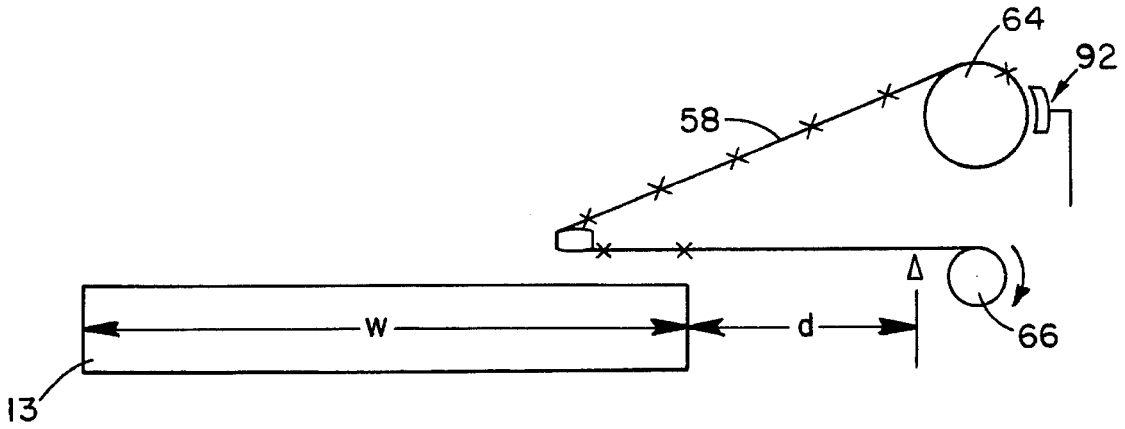
Figure 10F:
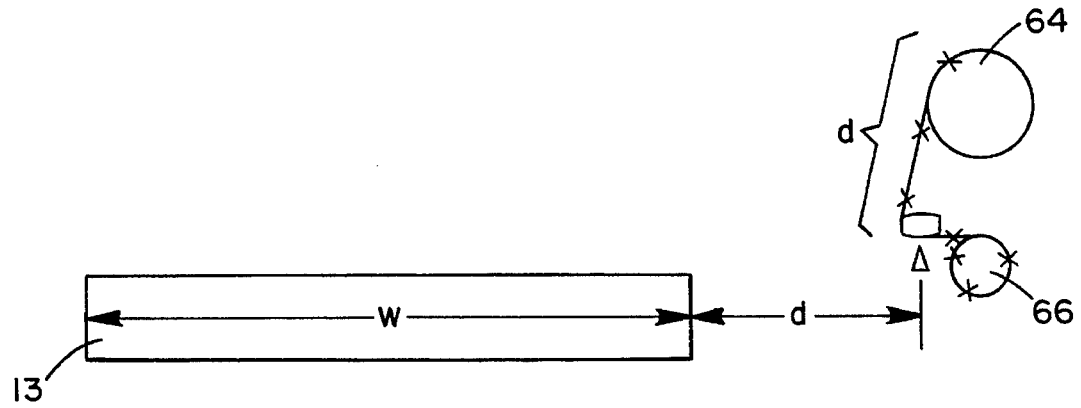

After the last image band is scanned and printed onto the copy sheet, the thermal printing head 25 is returned to the home position illustrated in FIG. 5 and 10F. In this special case of movement in the reversing direction C, the thermal printing head and drive system function according to the sequence illustrated in FIGS. 10A, 10B, 10E and 10F. More particularly, the supply spool 64 is urged into rotational movement as illustrated in FIG. 10B until such time as the thermal printing head reaches a position such as illustrated in FIG. 10E. In this position, the amount of spent ribbon between the thermal printing head 25 and the supply spool 64 is given as a=(w/2–d) the amount of spent ribbon between the thermal printing head 25 and the take-up spool 66 is given as b=(w/2+d).

After the thermal printing head 25 reaches the position illustrated in FIG. 10E, the motor 110 is reversed in a manner described above to toggle the control member 100 about the pivot 102 urging the take-up spool into take-up rotation and simultaneously clamping the supply spool 64. When the thermal printing head 25 reaches the home position illustrated in FIG. 10F, the amount of spent ribbon extending between the thermal printing head 25 and the supply spool 64 is d. The amount of spent ribbon between the thermal printing head 25 and the take-up spool 66 is w. In this manner, no ribbon is wasted between separate copy sheets. More particularly, for the next copy sheet, the thermal printing head advances in the scanning direction A unrolling a length d of spent ribbon 58 from the supply spool 64 until the thermal printing head 25 reaches the ready position illustrated in FIGS. 7A and 10D. At the ready position, only fresh ribbon 58 exists between the thermal printing head 25 and the supply spool 64.

The above scheme is easily modifiable to adjust the point of motor reversal to save ribbon on the latter portion of scans where there is no image on the document 14. The extra portion of unused new ribbon is recognized by the scanning head 17 during the scanning operation and the moment of motor reversal is thereby adjusted on the fly. This ensures than the leading edge, or beginning end, of unused ribbon registers with the thermal printing head 25 on the paper edge at the ready position (FIGS. 7A and 10D). A simple adjustment is similarly possible for those portions of the printing operation when the printing head moves to the home position (FIGS. 5 and 10F). Lastly, for multi-strike ribbon applications of this ribbon conservation method, the motor reversal is adjustable over the range of returning motion C in order that a portion of the used ribbon is rewound onto the supply spool 64.

This process is readily adaptable in color printing applications to ensure the proper registration of sequentially presented colored ribbon segments such as cyan, magenta, yellow and black. The color embodiment of the instant invention contemplates the use of a sensor for detecting the spaces between color segments of the ribbon and appropriately controls the rewind sequencing of the take-up and supply spools. This is performed in a manner such that the appropriate spool is rewound to suitably present colored ribbon segments for sequentially repeated scans over the same segment of the receiver sheet. One method is to detect the transparent area of the ribbon between the color portion using the sensor, then overprinting a single strip by each color (e.g. four scans) in turn before the paper sheet is advanced to print the next strip using four scans.

Figure 11:
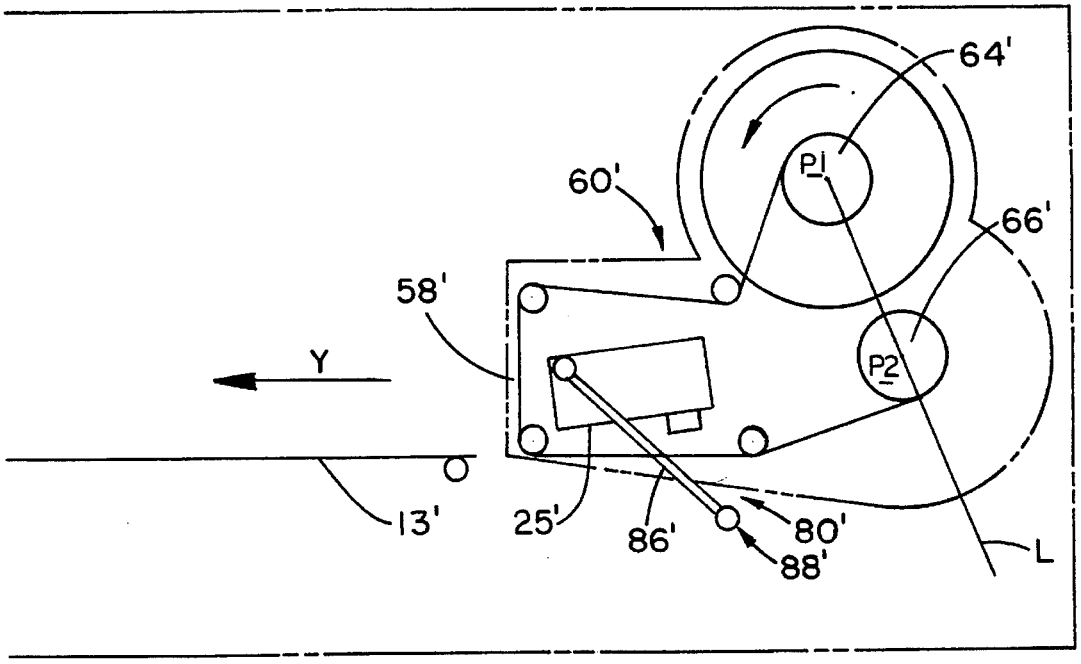
FIG. 11 is a plan X-ray view of a second preferred embodiment of the ribbon cassette housing disposed in an apparatus printing on the advancing stroke of the print head.

With reference now to FIG. 11, the ribbon cassette according to the present invention is illustrated in an alternative preferred embodiment as a housing containing two spools which are offset from the scanning direction of the print head or "stepped" instead of being disposed on line therewith as illustrated in FIG. 5. For ease of illustration and comprehension of this alternative, like components are identified by like numerals with a primed suffix (') and new components are identified by new numerals.

As indicated above, the preferred environment or application for the instant invention is in a portable copier apparatus. However, the present invention finds application as well in portable printer devices which essentially comprise the same overall hardware of the copier described above but for the absence of the reading head and imaging portions of the copier. Rather, portable printing apparatus merely receive signals from an associated computer device or the like for converting those signals into readable information on a printed page. Accordingly, as illustrated in FIG. 11, the alternative ribbon cassette 60' engages only the thermal printing head 25' without the need for threading through the gap 22 (FIG. 5) associated with copiers using a reading head 17 preceding the thermal printing head 25' for forming copies on the advancing stroke of the scanning carriage 20.

Since no reading head 17 is necessary in a printer application, the stripper bar 80' is pivotally attached directly to the thermal printing head 25'. As in the first preferred embodiment described above, the stripper bar 80' includes downwardly extending extension member 86' which lies in a plane parallel with the page as viewed in the Figure and a stripper roller 88' which lies in a plane perpendicular to or "into" the page of the Figure. Overall, the stripper bar 80' operates substantially as described above for peeling the ribbon 58' from the copy sheet 13' downstream of the printing operation on the advancing stroke of the thermal printing head 25' in a direction Y.

The supply spool 64' and take-up spool 66' are arranged in a manner such that their respective flanges for supporting the ribbon 58' overlap or slidably engage so as to conserve space within the ribbon cassette 60'. Each of the supply and take-up spools rotate about points P1 and P2, respectively. The points P1 and P2 define a line n which is skewed or obtuse with respect to the direction of thermal print head movement Y.

Figure 12:
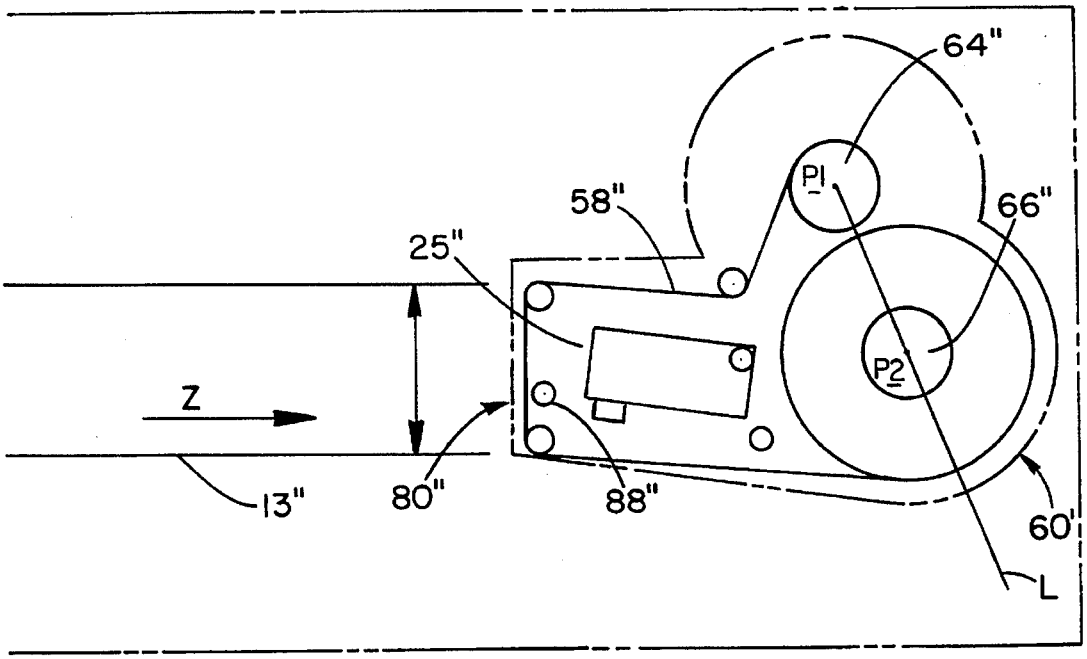
FIG. 12 is a plan X-ray view of a third preferred embodiment of the ribbon cassette housing of FIG. 11 disposed in an apparatus printing on the return stroke of the print head.

With reference next to FIG. 12, the ribbon cassette 60' of FIG. 11 is illustrated in a printer apparatus which operates to print on the return stroke of the print head instead of the advancing stroke. For ease of illustration and comprehension of this alternative, like components are identified by like numerals with a double primed suffix (") and new components are identified by new numerals.

In the printer apparatus illustrated in this Figure, the thermal printing head 25''' creates readable images on the copy sheet 13" while on the returning stroke which is in the direction Z in the Figure. The stripper bar 80" is attached to the print head and in this case is essentially a stripper roller 88" which lies in a plane perpendicular to or "into" the page of the Figure. Thus, the stripper roller 88" peels the ribbon 58" from the copy sheet 13" downstream of the print operation which is in the direction Z.

Figure 13:
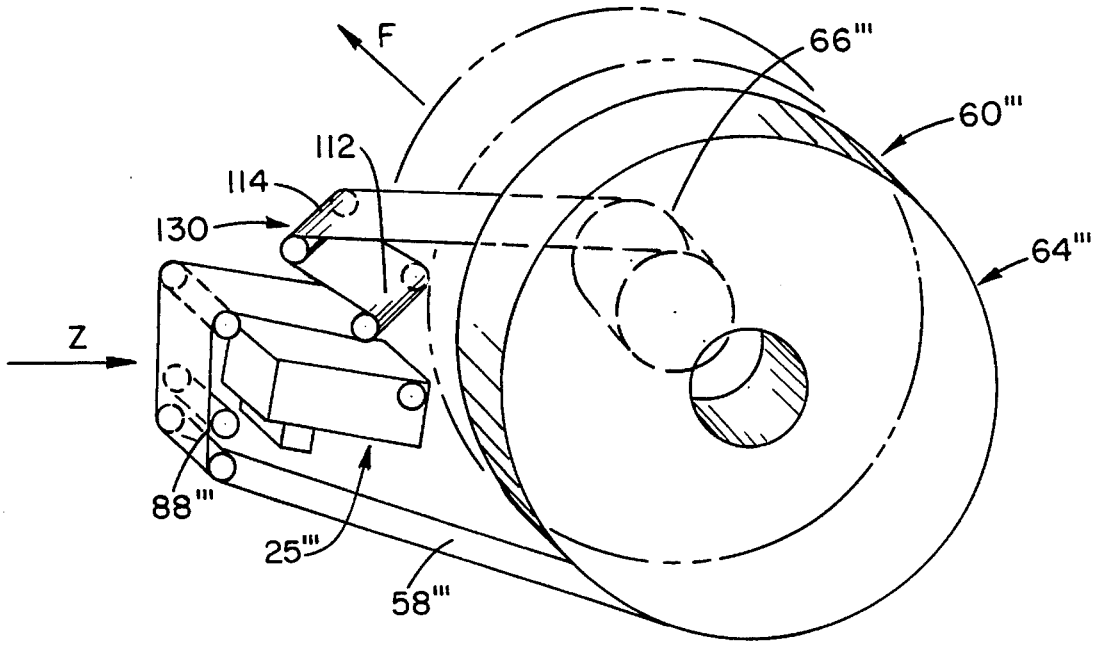
FIG. 13 is a perspective view in partial phantom of another preferred embodiment of the ribbon cassette housing for dual large spool capacities; and, FIG. 14 is a plan view in partial phantom of a drive system for use with the ribbon cassette housing of FIG. 13.
Figure 14:
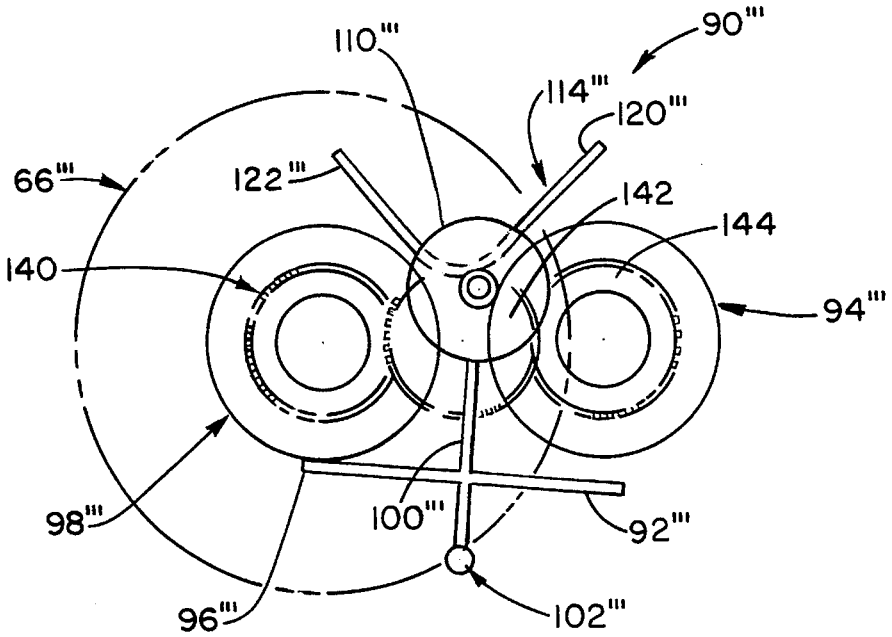

Turning now to FIGS. 13 and 14, an alternative embodiment of the ribbon cassette is illustrated as comprising two side by side spools instead of the spool arrangement illustrated in FIGS. 5, 11 and 12. For ease of illustration and comprehension once again, like components are identified by like numerals with a triple primed suffix (''') and new components are identified by new numerals.

The general arrangement of the supply spool 64''' and the take-up spool 66''' is best illustrated in FIG. 13. As can be seen in that Figure, each of the spools are co-axial in this preferred alternative embodiment. However, they need not be coaxially but only offset from one another in a direction F perpendicular to the plane of the page of that Figure which is perpendicular to the axis of the return stroke Z of the thermal printing head 25'''. As illustrated in FIG. 13, the thermal printing head 25''' is generally aligned with the supply spool 64''' such that the ribbon 58''' peels directly therefrom and across the thermal printing head 25''' and stripper roller 88'''. The take-up spool 66''', however, is offset from both the thermal printing head 25''' and the supply spool 64''' in order to make the most efficient use of the cross sectional footprint size of the cassette 60''' while maintaining maximum ribbon length.

A diverter roller mechanism 130 includes a first and second set of rollers 132, 134 respectively for laterally shifting the ribbon 58''' from the plane of the supply spool 64''' to that of the take-up spool 66'''. The first diverter roller 112 shifts the ribbon slightly while the second diverter roller 114 further shifts the ribbon 58''' towards the direction F where it is readily squarely received onto the take-up spool 66'''. Although this Figure illustrates only one divertes roller mechanism 118, a pair may be used in instances where three spaced apart parallel planes are defined by the supply spool 64''', the thermal printing head 25''' and the take-up spool 64'''. In that case, a first diverter roller mechanism (not shown) Shifts the ribbon from the plane of the supply spool 64''' to that of the thermal printing head 25''' The second diverter roller mechanism 110 further shifts the ribbon from the plane of the thermal printing head 25''' into that of the take-up spool 66''' for ready threading thereon.

With reference now to FIG. 14, the drive system 90''' of the second preferred ribbon cassette embodiment is illustrated. The drive system includes a supply spool brake member 92''' and a take-up spool brake member 96'''. A set of gears 140, 142 and 144 couple the ribbon supply spool to the ribbon take-up spool. The supply spool brake member 92''' selectively engages a supply spool circular member 94''' extending from the ribbon cassette and connected to the supply spool 64''' through the housing 62''' with a supply spool axle. Similarly, the take-up spool brake member 96''' selectively engages a take-up spool circular member 94''' which is connected to the take-up spool 66''' through a take-up spool axle 93'''. The supply spool brake member 92''' and the take-up spool brake member 96''' are connected to a control member 100''' which is pivotable about a pivot point 102'''. A small D.C. or stepper motor 110''' is attached to the control member 100''' and includes a first drive wheel 112''' engaging a raceway 114'''. The raceway includes a first ramped surface 120''' near the supply spool circular member 94''' and a second ramped surface 122''' adjacent the take-up spool circular member 98'''. In the preferred embodiment, the raceway 114''' is only semi-rigid to permit some flexing thereof in order to accommodate pivotal motion of the control member 100''' and drive wheel 112'''. Materials which exhibit the resilient characteristics similar to piano wire fixed to the housing on both ends work well for the raceway 114'''.

In the position illustrated in FIG. 14 which corresponds to the position of the printing operation, the electric motor 110''' is in an OFF or brake state. The drive wheel 110''' is engaged with both the first surface 120''' and the supply spool circular member 94'''. In this position, the supply spool 64''' is rotatable against the frictional force between the drive wheel 110''' and the supply spool circular member 94'''. On the other hand, the take-up spool circular member 98''' is engaged with the take-up spool brake member 96''' due to the toggle position of the control member 100'''. Accordingly, as the scanning carriage 20''' advances in the scanning direction A, the ribbon 58''' is pulled from the supply spool 64''' against the frictional force between the drive wheel 112''' and the supply spool circular member 94''' The take-up spool is effectively locked due to the engagement of the take-up spool brake member 96''' with the take-up spool circular member 98'''.

While the invention has been described with reference to specific embodiments thereof, it would be apparent to those skilled in the art that many alternatives, modifications and variations may be made. For example, while the invention has been illustrated with respect to having a scanner having a both a reading head and a thermal printing head, it would be understood that it has application to stand alone scanners and printers including impact type stand along printers. Accordingly, it is intended to embrace all such alternatives and modifications as may fall in the spirit of the appended claims.

Having thus described the invention, I now claim:

1. A ribbon accessory in combination with a printing apparatus having a movable print head and a drive member, the combination comprising:

a ribbon cassette housing;

an elongate print ribbon having a first end and a second end;

a first rotatable member on the housing and connected to said first end of the print ribbon;

a second rotatable member on the housing and connected to said second end of the print ribbon; and, brake means on the printing apparatus selectively engageable with said first rotatable member and said second rotatable member for alternately i) resisting rotation of said first rotatable member when in a first orientation engaging said first rotatable member, and ii) resisting rotation of said second rotatable member when in a second orientation engaging said second rotatable member.

2. The combination according to claim 1 further comprising:

a raceway on the printing apparatus; and, a following member, connected to said brake means and engaging said raceway, for selectively alternatively positioning said brake means in said first orientation responsive to the drive member of said operatively associated printing apparatus rotating in a first direction and positioning said brake means in said second orientation responsive to the drive member of said operatively associated printing apparatus rotating in a second direction.

3. The combination according to claim 1 further comprising a stripper bar member, on the movable print head, engaging the print ribbon for lifting a used portion of said print ribbon from a copy sheet downstream of a printing operation by said movable print head.

4. The combination according to claim 3 wherein said stripper bar member is pivotable on said movable print head to: engage the print ribbon in a first pivot position for lifting said used portion of said print ribbon from said copy sheet downstream of said printing operation and disengage the print ribbon in a second pivot position for providing access to said ribbon cassette housing.

5. The combination according to claim 4 further including means for pivoting said stripper bar member in said first and second pivot positions responsive to the position of said movable print head.

6. A method of printing onto a copy sheet adjacent a print head, the method comprising:

providing a ribbon cartridge having a housing, a supply spool, a take-up spool and a length of ribbon mounted upon said supply spool and extending in a path out of said housing and back into said housing to said take-up spool;

while printing with the print head onto the copy sheet, advancing a first quantity of the ribbon between the print head and the copy sheet in a first direction relative to the print head by:

i) permitting rotation of the supply spool in a first rotational direction;

ii) holding the take-up spool stationary; and, iii) slidably engaging the ribbon with the print head traversing in a first direction relative to the cartridge;

passing a first portion of said first quantity of ribbon between the print head and the copy sheet in a second direction relative to the print head opposite said first direction by:

i) driving the supply spool in a second rotational direction opposite the first rotational direction;

ii) holding the take-up spool stationary; and, iii) slidably engaging the ribbon with the print head traversing in a second direction relative to the cartridge opposite the first direction; and, advancing said first portion of said first quantity of ribbon between the print head and the copy sheet in said first direction relative to the print head by:

i) driving the take-up spool in a first rotational direction;

ii) holding the supply spool stationary; and, iii) slidably engaging the ribbon with the print head traversing in said second direction.

7. The method of printing according to claim 6 wherein:

the step of advancing said first quantity of ribbon includes advancing a first length W of ribbon between the print head and the copy sheet in said first direction relative to the print head; and, the step of passing said first portion of said first quantity of ribbon includes passing a second length W/2 of ribbon between the print head and the copy sheet in said second direction relative to the print head opposite said first direction.

8. The method of printing according to claim 7 wherein the step of advancing said first portion of said first quantity of ribbon includes advancing said second length W/2 of the ribbon between the print head and the copy sheet in said first direction relative to the print head.

9. The method of printing according to claim 6 wherein:

the step of advancing said first quantity of ribbon includes advancing a first length W of ribbon between the print head and the copy sheet in said first direction relative to the print head; and, the step of passing said first portion of said first quantity of ribbon includes passing a second length W/2+D of ribbon between the print head and the copy sheet in said second direction relative to the print head opposite said first direction.

10. The method of printing according to claim 9 wherein the step of advancing said first portion of said first quantity of ribbon includes advancing said second length W/2+D of the ribbon between the print head and the copy sheet in said first direction relative to the print head.

11. The method of printing onto a copy sheet according to claim 6 wherein the step of advancing said first quantity of the ribbon between the print head and the copy sheet in said first direction relative to the print head while printing with the print head includes the steps of:

slidably engaging an unused portion of the ribbon upstream of said printing with a first end of said print head traversing in a first direction relative to the cartridge; and, lifting a used portion of said ribbon downstream of said printing from said copy sheet with a second end of said print head.

12. The method of printing onto a copy sheet according to claim 6 wherein:

the step of driving the supply spool in said second rotational direction opposite the first rotational direction while holding the take-up spool stationary includes i) engaging the supply spool with a first member rotating in a first rotational direction and ii) engaging the take-up spool with a brake member; and, the step of driving the take-up spool in said first rotational direction while holding the supply spool stationary includes i) engaging the take-up spool with said first member rotating in a second rotational direction and ii) engaging the supply spool with said brake member.

13. The method of printing onto a copy sheet according to claim 12 wherein:

the steps of i) engaging the supply spool with a first member rotating in a first rotational direction and ii) engaging the take-up spool with a brake member include the step of positioning said first member and said brake member in a first orientation; and, the steps of i) engaging the take-up spool with said first member rotating in a second rotational direction and ii) engaging the supply spool with said brake member include the step of positioning said first member and said brake member in a second orientation.

14. The method of printing onto a copy sheet according to claim 13 wherein:

the step of positioning said first member and said brake member in said first orientation includes toggling said first member and said brake member into engagement with the supply spool and with the take-up spool respectively by engaging the first member rotating in said first rotational direction against a first surface; and, the step of positioning said first member and said brake member in said second orientation includes toggling said first member and said brake member into engagement with the take-up spool and with the supply spool respectively by engaging the first member rotating in said second rotational direction against said first surface.

15. A method of printing onto a copy sheet adjacent a print head, method comprising:

providing a ribbon cartridge having a housing, a supply spool, a take-up spool and a length of ribbon mounted upon said supply spool and extending in a path out of said housing and back into said housing to said take-up spool;

while printing with the print head onto the copy sheet, first advancing a first quantity of ribbon between the print head and the copy sheet in a first direction relative to the print head by:

i) driving the take-up spool in a first rotation direction;

ii) holding the supply spool stationary; and, iii) slidably engaging the ribbon with the print head traversing in a first direction relative to the cartridge;

passing a first portion of said first quantity of ribbon between the print head and the copy sheet in a second direction relative to the print head opposite the first direction by:

i) permitting rotation of the take-up spool in a second rotational direction opposite the first rotation direction;

ii) holding the supply spool stationary; and, iii) slidably engaging the ribbon with the print head traversing in a second direction relative to the cartridge opposite the first direction; and, second advancing said first portion of said first quantity of ribbon between the print head and the copy sheet in said first direction relative to the print head by:

i) permitting rotation of the supply spool in a first rotational direction;

ii) holding the take-up spool stationary; and, iii) slidably engaging the ribbon with the print head traversing in said direction.

16. The method of printing according to claim 15 wherein: the step of first advancing said first quantity of ribbon includes advancing a first length W of ribbon between the print head and the copy sheet in said first direction relative to the print head; and, the step of passing said first portion of said first quantity of ribbon includes passing a second length W/2 of ribbon between the print head and the copy sheet in said second direction relative to the print head opposite said first direction.

17. The method of printing according to claim 16 wherein:

the step of second advancing said first portion of said first quantity of ribbon includes advancing said second length W/2+D of the ribbon between the print head and the copy sheet in said first direction relative to the print head.

18. The method of printing according to claim 15 wherein:

the step of first advancing said first quantity of ribbon includes advancing a first length W+D of ribbon between the print head and the copy sheet in said first direction relative to the print head; and, the step of passing said first portion of said first quantity of ribbon includes passing a second length W/2+D of ribbon between the print head and the copy sheet in said second direction relative to the print head opposite said first direction.

19. The method of printing according to claim 18 wherein the step of second advancing said first portion of said first quantity of ribbon includes advancing a third length W/2 of the ribbon between the print head and the copy sheet in said first direction relative to the print head.

20. The method of printing onto a copy sheet according to claim 15 wherein the step of first advancing said first quantity of the ribbon between the print head and the copy sheen in said first direction relative to the print head while printing with the print head includes the steps of:

slidably engaging an unused portion of the ribbon upstream of said printing with a first end of said print head traversing in a first direction relative to the cartridge; and, lifting a used portion of said ribbon downstream of said printing from said copy skeet with a second end of said print head.

21. The method of printing onto a copy sheet according to claim 15 wherein:

the step of driving the take-up spool in said first rotational direction while holding the supply spool stationary includes: i) engaging the take-up spool with a first member rotating in a first rotational direction and ii) engaging the supply spool with a brake member.

22. The method of printing onto a copy sheet according to claim 15 wherein:

the step of driving the supply spool in said second rotational direction opposite the first rotational direction while holding the take-up spool stationary includes i) engaging the supply spool with a first member rotating in a first rotational direction and ii) engaging the take-up spool with a brake member; and, the step of driving the take-up spool in said first rotational direction while holding the supply spool Stationary includes i) engaging the take-up spool with said first member rotating in a second rotational direction and ii) engaging the supply spool with said brake member.

23. The method of printing onto a copy sheet according to claim 22 wherein:

the steps of i) engaging the supply spool with a first member rotating in a first rotational direction and ii) engaging the take-up spool with a brake member include the step of positioning said first member and said brake member in a first orientation; and, the steps of i) engaging the take-up spool with said first member rotating in a second rotational direction and ii) engaging the supply spool with said brake member include the step of positioning said first member and said brake member in a second orientation.

24. The method of printing onto a copy sheet according to claim 23 wherein:

the step of positioning said first member and said brake member in said first orientation includes toggling said first member and said brake member into engagement with the supply spool and with the take-up spool respectively by engaging the first member rotating in said first rotational direction against a first surface; and, the step of positioning said first member and said brake member in said second orientation includes toggling said first member and said brake member into engagement with the take-up spool and with the supply spool respectively by engaging the first member rotating in said second rotational direction against said first surface.

25. A ribbon in combination with a printing apparatus having a moveable print head and a drive member, the combination comprising:

a ribbon cassette housing;

an elongate print ribbon having a first end and a second end;

a first rotatable member on the housing and connected to said first end of the print ribbon;

a second rotatable member on the housing and connected to said second end of the print ribbon;

a stripper bar member, on the moveable print head, engaging the print ribbon for lifting a used portion of said print ribbon from a copy sheet downstream of a printing operation by said moveable print head; and, brake means on the printing apparatus selectively engageable with said first rotatable member and said second rotatable member for alternately engaging and braking said first rotatable member when in a first orientation and engaging and breaking said second rotatable member when in a second orientation.

26. The combination according to claim 25 wherein said stripper bar member is pivotable on said moveable print head engage the print ribbon in a first pivot position for lifting said used portion of said print ribbon from said copy sheet downstream of said printing operation and disengage the print ribbon in a second pivot position for providing access to said ribbon cassette housing.

27. A method of color printing comprising:

a) providing a color ribbon having a regularly repeated sequence of a plurality of color segments, each of the repeating sequences being separated from each other on the ribbon by an indicia portion of the ribbon;

b) advancing a first length W of the ribbon between a print head and a copy page from a supply spool while simultaneously printing onto a first width-wise strip of the copy page;

c) sensing a first indicia portion of the ribbon being advanced;

d) stopping the advancing ribbon when the first indicia portion is sensed;

e) retracting a first portion W/2 of said said first length of the ribbon between the print head and the copy page onto said supply spool;

f) retracting a second portion W/2 of said said first length of the ribbon between the print head and the copy page onto a take-up spool; and, g) repeating steps b–f.

28. The method according to claim 27 wherein the step of repeating steps b–f includes the step of repeating steps b–f once for each of the plurality of color segments.

29. The method according to claim 28 wherein the step of advancing a first length of the ribbon between a print head and a copy page while simultaneously printing onto a first width-wise strip of the copy page includes simultaneously printing a one of the plurality of color segments from the color ribbon onto the first width-wise strip of the copy page.

30. The method according to claim 29 further comprising:

h) advancing a second length of the ribbon between the print head and the copy page while simultaneously printing onto a second width-wise strip of the copy page;

i) sensing a second indicia portion of the ribbon being advanced;

j) stopping the advancing portion when the second indicia portion is sensed;

k) retracting said second length of the ribbon between the print head and the copy page; and, l) repeating steps h–l;

31. A ribbon accessory in combination with a printing apparatus having a movable print head and a drive member, the combination comprising:

a ribbon cassette housing;

an elongate print ribbon having a first end and a second end;

a first rotatable member on the housing and connected to said first end of the print ribbon;

a second rotatable member on the housing and connected to said second end of the print ribbon; and, a movable brake adapted for movement into a first position engaging said first rotatable member and movement into a second position engaging said second rotatable member.

32. The combination according to claim 31 further comprising:

a raceway on the printing apparatus; and, a following member, connected to said brake and engaging said raceway, for selectively alternatively positioning said brake in said first position responsive to the drive member of said operatively associated printing apparatus rotating in a first direction and positioning said brake in said second position responsive to the drive member of said operatively associated printing apparatus rotating in a second direction.

33. The combination according to claim 31 further comprising a stripper bar member, on the movable print head, engaging the print ribbon for lifting a used portion of said print ribbon from a copy sheet downstream of a printing operation by said movable print head.

34. The combination according to claim 33 wherein said stripper bar member is pivotable on said movable print head to i) engage the print ribbon in a first pivot position for lifting said used portion of said print ribbon from said copy sheet downstream of said printing operation and ii) disengage the print ribbon in a second pivot position for providing access to said ribbon cassette housing.

35. The combination according to claim 34 further including means for pivoting said stripper bar member in said first and second pivot positions responsive to the position of said movable print head.

* * * * *